US007617657B2

(12) United States Patent
Liu

(10) Patent No.: US 7,617,657 B2
(45) Date of Patent: Nov. 17, 2009

(54) METHOD FOR PACKAGING SCALLOPS IN A TUBULAR BAG

(75) Inventor: Davis Liu, Dongguan (CN)

(73) Assignee: Wlkay Plastics Co., Inc., Commerce, CA (US)

( * ) Notice: Subject to any disclaimer, the term of this patent is extended or adjusted under 35 U.S.C. 154(b) by 442 days.

(21) Appl. No.: 11/586,374

(22) Filed: Oct. 25, 2006

(65) Prior Publication Data

US 2008/0101732 A1 May 1, 2008

(51) Int. Cl.
*B65B 1/04* (2006.01)

(52) U.S. Cl. ..... 53/469; 53/479; 53/567; 53/585

(58) Field of Classification Search ..... 53/469, 53/479, 567, 585
See application file for complete search history.

(56) References Cited

U.S. PATENT DOCUMENTS 2,911,307 A * 11/1959 Handler ..... 53/449
3,811,411 A * 5/1974 Moeller ..... 119/241
3,839,525 A * 10/1974 Doll ..... 264/154
5,226,735 A * 7/1993 Beliveau ..... 383/103
5,492,705 A * 2/1996 Porchia et al. ..... 426/106
6,286,681 B1 * 9/2001 Wilfong et al. ..... 206/554
6,391,357 B1 * 5/2002 Muise et al. ..... 426/407

OTHER PUBLICATIONS

Brue Lipsitt; Metallocene Polyethylene Films as alternative to flexible PVC for Medical Device Fabrication; Sep. 1997; Medical Device Inc.; pp. 1-5.*

* cited by examiner

*Primary Examiner*—Hemant M Desai
(74) *Attorney, Agent, or Firm*—Fulwider Patton LLP

(57) ABSTRACT

An elongate, tubular, transparent thin-film scallop bag formed with a tapered, open top edge and a closed bottom edge, and sized to hold a column of scallop medallions. The bag includes a plurality of regularly spaced perforations for eliminating trapped and excess moisture trapped during the filling of the bag with the scallops, and further formed with at least one vent hole larger than said perforations near the base of the bag to relieve back air pressure during the loading process. The bag's composition includes at least a twenty percent mixture of linear low density polyethylene (LLDPE), at least a thirty percent low density polyethylene (LDPE), and at least forty-five percent Metallocene 8C. The novel composite provides the requisite strength for a thickness that can carry the necessary perforations spacing without tearing or stretching, while providing a surface characteristic that is smooth and allows the scallops to slide easily into the bag.

6 Claims, 2 Drawing Sheets

METHOD FOR PACKAGING SCALLOPS IN A TUBULAR BAG

BACKGROUND OF THE INVENTION

Scallops are a favorite seafood delicacy that are incorporated into many dishes or served as an entree. A scallop is a bivalve mollusk with a fan-shaped shell from which its name is derived. The shells are characterized by radiating ribs or grooves and concentric growth rings. Near the hinge, where the two valves (shells) meet, the shell is flared out on each side forming small "wings". Just inside each valve along the edge of the mantle is a row of short sensory tentacles and a row of small blue eyes. The shells are opened and closed by a single, over-sized adductor muscle which is sometimes referred to as the "eye". The eye, or adductor muscle is the part of the scallop that is consumed in the U.S., where it is often referred to as a "medallion" because of its shape. The adductor muscle is more developed in the scallop than in oysters and clams because scallops are active swimmers. They glide freely through the water and over the sea floor by snapping their shells together.

Scallops are primarily harvested by dredging and are shucked soon after capture. They cannot hold their shells closed; therefore, once they are out of the water, they lose moisture quickly and die. Consequently, they're shucked on board the ships, placed in containers, and refrigerated. For large commercial operations, a machine is used to shuck the scallops and the medallions are then immediately placed in a bag for sale, usually that day. However, bags that are specifically designed for the presentation and preservation of scallop medallions and that include all of the features of the present invention are not found in the art.

SUMMARY OF THE INVENTION

An elongate, tubular, transparent thin-film scallop bag is formed with a tapered, open top edge and a closed bottom edge, and sized to hold a column of scallop medallions. The bag includes a plurality of regularly spaced perforations for eliminating collected excess moisture trapped during the filling of the bag with the scallops. The bag is further formed with at least one vent hole larger than said perforations near the base of the bag to relieve back air pressure during the loading process. In order to achieve the proper strength characteristics, the inventor has originated a material composite for making the bag of the present invention that includes at least twenty percent mixture of linear low density polyethylene (LLDPE), at least thirty percent low density polyethylene (LDPE), and forty-five percent Mettallocene 8C. The novel composite provides the requisite strength for a thickness that can carry the necessary perforations spacing without tearing or stretching, while providing a surface characteristic that is smooth and allows the scallops to slide easily into the bag.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
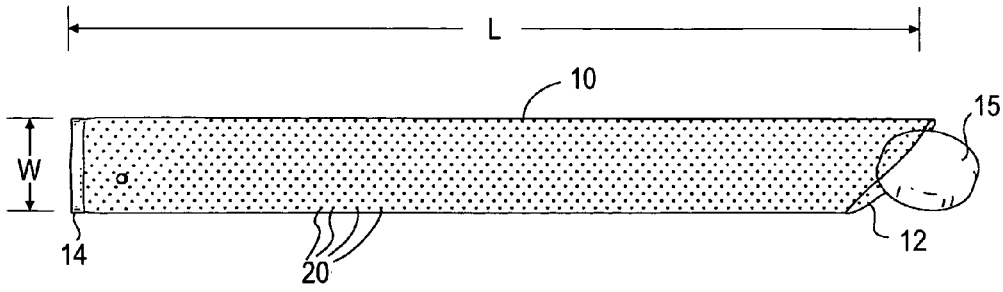
FIG. 1 is a top view of a first embodiment of the present invention.
Figure 2:
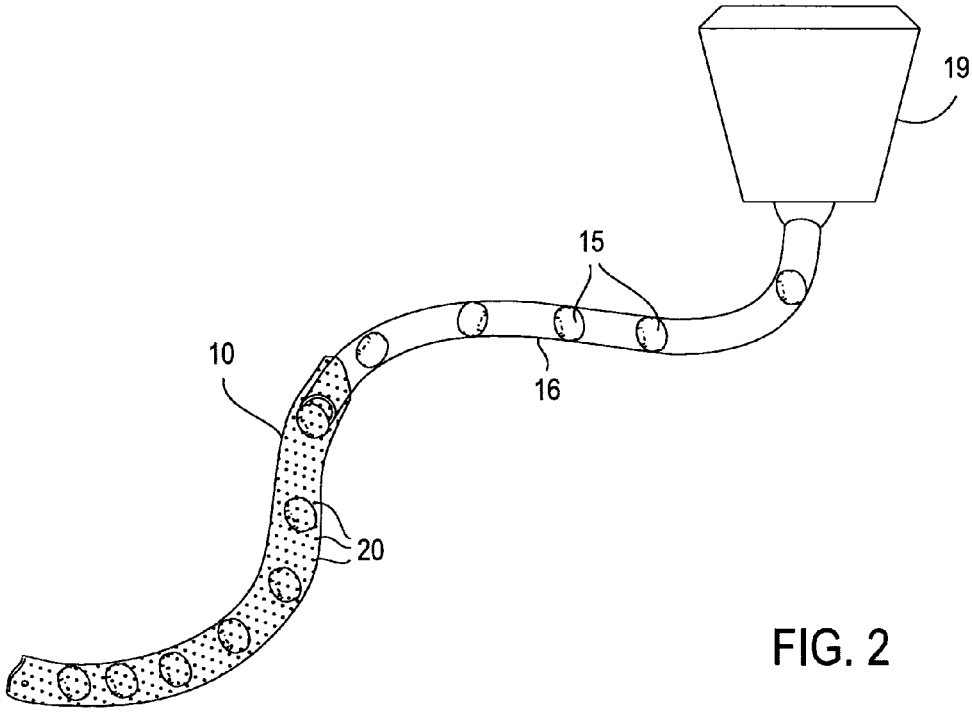
FIG. 2 is a perspective view of the embodiment of FIG. 1 incorporating a scallop loading tube.
Figure 3:
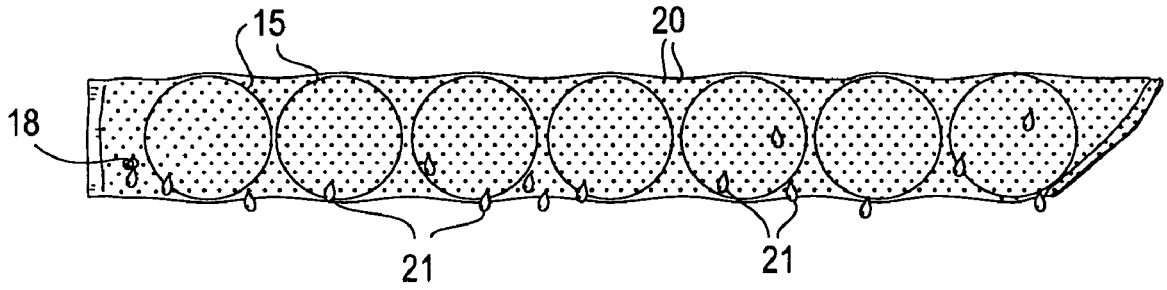
FIG. 3 is a top view of the embodiment of FIG. 1 where the bag is filled with scallops and ready for closing.

For a better understanding of the present invention together with other and further objects, advantages and capabilities thereof, reference is made to the following disclosure and appended claims in connection with the above described drawings. FIG. 1 illustrates a first preferred embodiment of the present invention comprising an elongate, thin film plastic bag used specifically for the presentation and preservation of scallop medallions 5. The bag 10 is cylindrically shaped thin film plastic bag have a tapered or angle top edge 12 that is open, and a sealed bottom edge 14. The angled top edge 12 facilitates opening the bag and also makes it easier to place the bag 10 on the end of a pipe or spout 16 of a shucking machine 19. Machines that shuck scallops, oysters, clams, and the like are well known in the art and a description of such is beyond the scope of the present patent, but such machines traditionally include a delivery system that includes a pipe 16 having a diameter sized to deliver a scallop medallion 15. The machine 16 may sort the unshelled medallions 15 into different diameters so that a batch or bag of scallops are all roughly the same size for merchandizing purposes. Accordingly, the diameter of the bag 10 is be selected based on the size of the pipe 16 and hence the diameter of the scallop medallions 15, and the beveled or angled top edge 12 facilitates the opening and placement of the bag 10 on the shucking machine pipe 16.

The thin film bag 10 is transparent so as to permit a clear view of the contents of the bag, which is critical to the sales of seafood. One preferred length L of the scallop bag is approximately thirty inches long with a width W of between one and one half to two and one half inches, or a range of between 20:1-12:1, inclusive, ratio of length L to width W with the bag laid flat and empty. As the scallops 15 are loaded from the pipe 16 into the bag 10, the scallops 15 will be typically accompanies by seawater and fluids 21 extracted during the shucking operation. These excess fluids 21 will collect at the bottom of the bag and between scallops 15, and combined with the weight of the scallops place unnecessary weight on the bag. Air can also be trapped in the bag and place pressure in the surface of the bag as the scallops are loading into the bag. Because the bags 10 are thin, to prevent tearing of the bag a pair of vent holes 18 are located at the base of the bag 10, three eights of an inch from the bottom edge 14 with a diameter of approximately one eighth inch. As air and fluids collect in the bag and travel to the bottom, the vent holes 18 allow the evacuation of the air and fluids to prevent unnecessary weight and pressure from building up during the loading process.

The bag 10 is further provided with a series of microperforations 20 that are much smaller than the vent holes 18 and extend predominantly across the entire surface of the bag 10. The microperforations are formed by pressing a grid of needle or pin-like elements onto the bag to create small openings, where the openings (less than one millimeter in diameter) are capable of draining moisture or air bubbles caught in the interior of the bag and which cannot be evacuated through the vent holes 18 at the bottom of the bag. The spacing of the microperforations is important in that too close of spacing can result in a weakness that can lead to the bags tearing upon encountering any shear or tension during the loading or shipping of the filled bags, where as too large of spacing will be ineffective to drain the bag. Applicant has found that a spacing of approximately five millimeters, resulting in approximately 29 perforations per square inch, can be a preferred sampling for draining the bag without presenting undue risk of premature tearing of the bag 10.

The scallops 15 are loaded into the bag 10 at a rate that will not promote tearing, and when the bag is full it is removed from its connection with the tube 16 and excess air is removed before closing the bag 10. The scallop medallions 15 are arranged so as to form a column of preferably like diameter specimens whose sides may be individually viewed through the bag. The sealing of the upper edge 12 of the bag 10 first squeezes the contents to force moisture and air through the microperforations 20 while other fluids drain through the vent holes 18. The bag is then tied or mechanically sealed with heat and the scallops placed on ice until they can be sold.

The bag has certain strength requirements that are particular to the present use, given the weight and pressure placed upon the surface of the bag and the presence of microperforations across the entire surface of the bag. Further, the bag is subjected to cold temperatures which can adversely affect the strength characteristics in some bags of this type. The inventor thus undertook to create a novel polymer blend to create a scallop bag with the requisite strength and yield characteristics for the present application.

A preferred composite mixture includes a custom blend of polymers including at least a twenty percent mixture of linear low density polyethylene (LLDP) and a thirty percent mixture of low density polyethylene (LDP). A preferred embodiment of the present invention will further include forty-five percent mixture of Metallocene 8C, a relatively new catalyst used to strengthen polyethylenes. The composite thin film may also include between 1% and 5% of ethylene vinyl acetate (EVA). The foregoing composite polymer has been found to produce a bag with the proper strength and tear resistance even in cold temperatures, despite the presence of microperforations in a closely-spaced grid pattern across the surface. The composite also meets all pertinent FDA regulations and standards for the storage and sale of shellfish. The surface of the bag has a low coefficient of friction that promotes high slip, making the bag easier to load and prevents jamming. The fact that the bag is extruded and thus does not have a side slit reinforces the strength of the bag, where a side seam represents a weakness that tends to cause separation at high stress loads. The narrow width of the bags allows the scallops to be visually inspected, and even the texture of the medallions can be evaluated with the thin skin of the bag tightly pressed against the peripheral edges of the scallops. The bag of the present invention as stated is well suited for cold temperatures, and the spacing and size of the perforations permit venting and evacuation of undesired trapped air and moisture. The custom blend of LLDPE, LDPE, Metallocene, and EVA produces a high slip, high strength transparent bag that can withstand the pressures of high speed loading of the scallops without bursting. The longitudinally seamless bag will not prematurely split or tear, and the use of vent holes in the bottom portion of the bag prevents bursting during the loading step. The above described embodiments are intended to be illustrative of the present invention and not restrictive, as the full scope of the claims are dictated solely by the words of the appended claims.

Those of ordinary skill in the art will appreciate that minor modifications and alterations will be possible without deviating from the scope of the invention, and said modifications and alterations are intended to be included in the scope of the invention.

I claim:

1. A method for packaging scallop medallions comprising the steps of:

providing a machine for distributing scallops in their unshelled state through a tube;

providing a transparent tubular bag with a grid pattern of perforations and first and second vent holes along a lower portion;

connecting the transparent tubular bag to the machine;

begin distributing scallops into the transparent bag, where said vent holes direct excess air pressure accumulated during the distribution process out of the bag;

continue distributing scallops into said bag until full at a rate so as not to incur tearing or stretching of said bag; and sealing said top portion of said bag so as to force excess pressure and moisture through said perforations.

2. The method of claim 1 wherein the tubular bag includes a composition including Metallocene 8C.

3. The method of claim 2 wherein the tubular bag further includes low density polyethylene.

4. The method of claim 1 further comprising the step of selecting the bag based on the diameter of the scallops to be packaged.

5. The method of claim 1, wherein the step of connecting the transparent tubular bag is preceded by cutting a portion of a top end of said bag to establish an angled profile.

6. The method of claim 1 further comprising the step of establishing the vent holes approximately three eighths of an inch from the bottom of the bag, where said vent holes have a diameter of approximately one eighth of one inch.

* * * * *